United States Patent [19]

Hayes

[11] Patent Number: 4,768,780

[45] Date of Patent: Sep. 6, 1988

[54] HAND GRASP DEVICE

[76] Inventor: Robert G. Hayes, 1148 Idaho St., Elko, Nev. 89801

[21] Appl. No.: 944,801

[22] Filed: Dec. 19, 1986

[51] Int. Cl.[4] ..... A63B 11/00

[52] U.S. Cl. ..... 272/122; 272/67; 272/123; 272/143

[58] Field of Search ..... 272/67, 68, 117, 119, 272/122, 123, 124, 143, DIG. 4; 273/165

[56] References Cited

U.S. PATENT DOCUMENTS

| | | | |
|---|---|---|---|
| 734,062 | 7/1903 | Harris . | |
| 742,393 | 10/1903 | Chellis et al. . | |
| 2,617,650 | 11/1952 | Landis | 272/122 |
| 4,231,569 | 11/1980 | Rae | 272/67 X |
| 4,312,506 | 1/1982 | Brennan | 272/123 |
| 4,327,908 | 5/1982 | James | 272/119 |
| 4,345,756 | 8/1982 | Hoagland | 272/122 X |
| 4,484,740 | 11/1984 | Green | 272/119 |
| 4,589,655 | 5/1986 | Ammon | 272/67 |
| 4,607,840 | 8/1986 | Harper | 272/122 X |
| 4,627,618 | 12/1986 | Schwartz | 272/122 |
| 4,720,098 | 1/1988 | Gordon | 272/122 |

*Primary Examiner*—Richard J. Apley
*Assistant Examiner*—Robert W. Bahr
*Attorney, Agent, or Firm*—Workman, Nydegger & Jensen

[57] ABSTRACT

A device which facilitates the user's grasp and ability to lift a weight when the hand is oriented in a palm down position. The invention comprises a grip member which the user grasps in an overhand fashion. Also provided is a rest member which is adapted to support, and distribute, a load on the back of the user's hand. A structure is provided which allows the grip member, as it is grasped by the user and the device is lifted in an upward direction, to move towards the rest member until the back of the user's hand firmly contacts the rest member. Once the back of the user's hand is contacting the rest member, the back of the hand is providing the support for the load, rather than the thumb and the fingers, but yet the grasp of the fingers and thumb keep the device in the proper position.

33 Claims, 3 Drawing Sheets

HAND GRASP DEVICE

BACKGROUND

1. The Field of the Invention

The present invention generally relates to devices used to allow the human hand to grasp an object, such as a cylindrical bar, in a palms down position, also referred to as an overhand position, with little fatigue. More particularly, the present invention relates to devices for providing a suitable grip on lifting apparatus used for weight training.

2. The Background Art

Increasing numbers of health conscious individuals are actively participating in weight training. The phrase weight training generally refers to the use of resistance supplied by weights, or resistance supplied by machine, against the movement of various parts of the human body. The benefits that come with weight training, both as a sport and as physical therapy, are generally recognized by both the public and those involved in the activity.

Weight training is an important part of many people's routine for promoting physical fitness. Furthermore, many individuals are involved in competitive weight lifting (such as events to see who is able to lift the greatest weight) and competitive body building (to develop a desirable physique). In weight training, a variety of individual exercises are intended to stress particular muscles of the body. It is through the multiple application of resistance against the contraction of a muscle (also known as "stressing" the muscle) that maximum muscular size and strength can be achieved.

As the popularity of weight training has increased, various devices have been proposed in order to purportedly improve the efficiency of the exercise being performed. These devices range from slight modifications to conventional dumbbells or barbells to extremely complex and expensive mechanical devices that are intended to provide a specialized and efficient workout, that is, one which provides the maximum work for a particular muscule. Often such specialized devices are often intended to work only a particular muscle, or a group of muscles.

Many of the exercises which are intended to work the muscles of the arms and upper torso, whether using the ordinary barbells, dumbbells, or a sophisticated machine, require that the user maintain a firm grasp on some type of grip. Generally, the grip will be a cylindrical bar, either a portion of the bar found on an ordinary barbell or dumbbell or a bar portion of the mechanical exercise device.

It is important to note that certain exercises for the arm, wrist, and upper body require that the user grasp the grip or bar in a "palm up" position. The term "curl" generally refers to an exercise wherein a barbell is grasped in a palms up position and the weight is raised upward and toward the body. Curls may also be similarly performed using only the wrist rather than the whole arm. Another common exercise is the standing lateral raise. Standing lateral raises are performed by holding a weight to the side of the body and grasping the bar with the hand and raising the bar upward and outward from the body.

Each of these exercises, curls, wrist curls, and lateral raises, can be performed in a "reverse" position. The reverse position is the "palm down" or "overhand," position. With the palm facing down, the muscles of the arm are oriented differently than when the exercise is performed in the palm up position and thus different muscles are worked.

However, when performing reverse curls or reverse wrist curls, it is often the case that certain muscles or parts of the body fatigue more quickly than others. With these two exercises in particular, since the weight or resistance is being borne principally by the thumb, and somewhat by the fingers, the fingers and particularly the thumb, often quickly become fatigued. Thus, the maximum resistance, or weight, and number of repetitions that can be performed is often limited by the strength of the muscles supporting the thumb and fingers, rather than the muscles which the exercise is intended to work.

FIG. 1, labeled prior art, shows a hand in the palm down position as is used when performing reverse wrist curls. To perform the exercise, the bar 12 and weights 20 are moved in the directions of arrow 36.

It is a common practice to use a support for the arm while performing reverse curls and reverse wrist curls. In the case of reverse wrist curls, it is common to perform the exercise while seated and to place the forearm on the top of the thigh with the wrist positioned over the knee.

By examining FIG. 1, it will be appreciated that the weight of the bar is principally supported by thumb 30, and somewhat by fingers 26 at a point indicated by arrow 32. Thus, the thumb and fingers used to maintain the grasp on the bar may become excessively fatigued before the muscles which the exercise is intended to work are adequately worked. When the thumb and fingers become excessively fatigued, there is the danger that the grasp on the weight will be lost while performing an exercise. Losing the grasp while exercising may result in injury to both people and property due to the resulting fall of the weight.

While very sophisticated devices are now available to work particular muscles of the body, little attention has been paid to providing a device to lessen the fatigue on the thumb and fingers when performing "palm down exercises" such as reverse wrist curls.

Thus, there has been a long felt need in the art to provide a device which can be used during weight training which will lessen the fatigue on the thumb and fingers when performing reverse wrist curls, and similar excercises, but yet still provide the desired benefit to the selected muscles.

It would also be an advance in the art to provide such a device which is relatively simple to manufacture and thus economical to produce. It would also be an advantage to produce such a device which was compact and of sturdy and rugged construction so as to withstand the rigors of hard use. A further advantage would be to provide such a device which could be used in a dumbbell configuration or a barbell configuration.

Yet another advance would be to produce such a device that could be used to retrofit conventional barbells and dumbbells. Still further, it would be an advance in the art to provide a device which would be particularly suited for performing reverse wrist curls using the one's leg and knee as a support. It would also be beneficial to provide a device which would allow reverse curls to be performed without the danger of the weight being inadvertently dropped due to the thumb and fingers becoming fatigued.

BRIEF SUMMARY AND OBJECTS OF THE INVENTION

The present invention improves the user's grasp on an object when the hand is in a palm down position. Briefly, the invention comprises a grip member which the user grasps in a palm down, or overhand, position. Also provided is a rest member which is adapted to support, and distribute, a load, generally a weight or the resistance supplied by a mechanical device, across the back of the user's hand.

A structure is provided which allows the grip member, as it is grasped by the user and as the device is lifted in an upward direction, to move towards the rest member until the back of the user's hand contacts the rest member. Once the back of the user's hand is contacting the rest member, the back of the hand is providing the support for the weight, rather than the thumb and fingers, but yet the grasp of the thumb and fingers on the grip member keep the device in the proper position.

The invention may be expressed in many different embodiments and may have applications other than in weight training devices. Further, it should be appreciated that many different structures, which can generally be referred to as positioning structures, can be used in order to allow the grip member to move. Several of the preferred embodiments illustrated herein are particularly well suited for performing reverse wrist curls with the arm resting on the thigh so that the knee and lower leg do not interfere with the exercise.

In view of the foregoing, it is a primary object of the present invention to provide a device which reduces thumb and finger fatigue when a user grasps and lifts a weight in the palms down position.

Another object of the present invemntion is to provide a device which allows reverse curls, and similar weight lifting exercises, to be performed without causing excessive fatigue of the thumb and fingers.

Still another object of the present invention is to provide a weight training device which may be used to retrofit conventional dumbbells and barbells.

Another object of the present invention is to provide a weight lifting device which can be incorporated into either dumbbells or barbells.

Yet another object of the present invention is to provide a weight lifting device for performing reverse wrist curls which allow the exercise to be performed while using the user's leg as a support without interference from the user's knee and lower leg.

Another object of the present invention is to provide a device which allows exercises such as reverse curls to be performed without concern for dropping the weight due to thumb and finger fatigue.

These and other objects of the present invention will be further appreciated by consideration of the following description of the preferred embodiments taken in connection with the accompanying drawings.

DETAILED DESCRIPTION OF THE PREFERRED EMBODIMENTS

Reference will now be made to the drawings wherein like structures are referenced by like numerals throughout. Reference will first be made to a presently preferred embodiment, generally designated 100, illustrated in FIG. 2.

Figure 2:
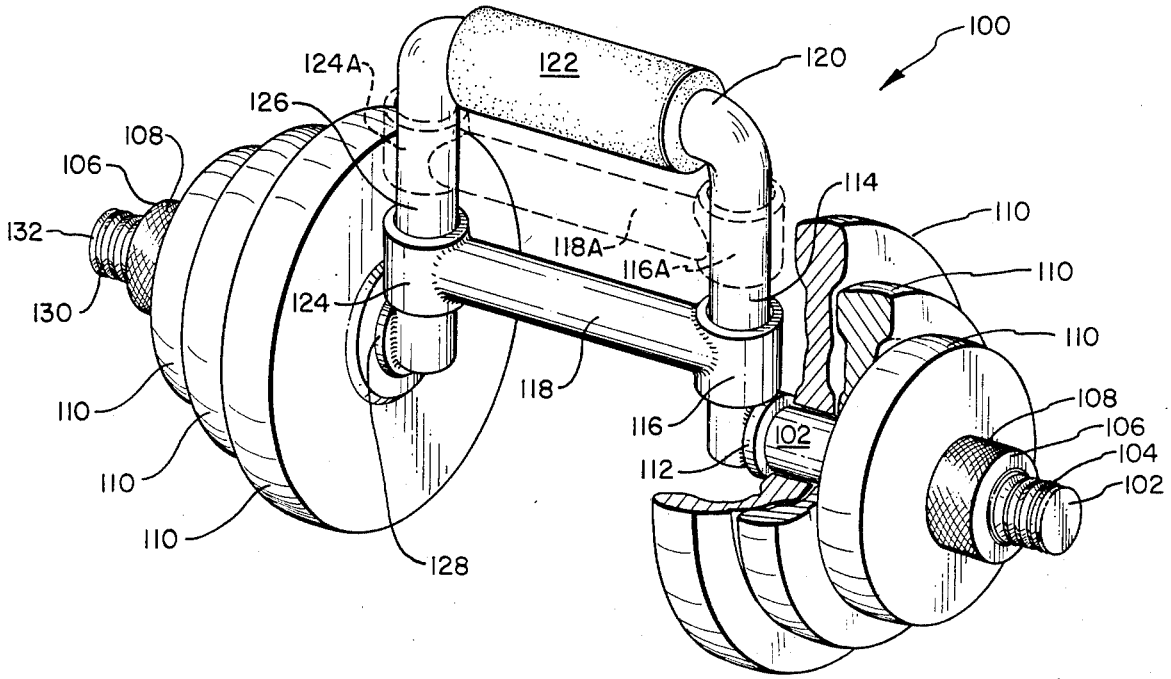
FIG. 2 is a perspective view of one presently preferred embodiment of the present invention used as a dumbbell and showing the grip member in a first position as a solid image and in a second position as a phantom image.

As can be seen in FIG. 2, the embodiment generally comprises a U-shaped member including substantially parallel legs 114 and 126 and an interconnecting member, or bar, 120. Interconnecting member or bar 120 is provided with padding 122 for reasons that will be explained shortly.

Figure 1:
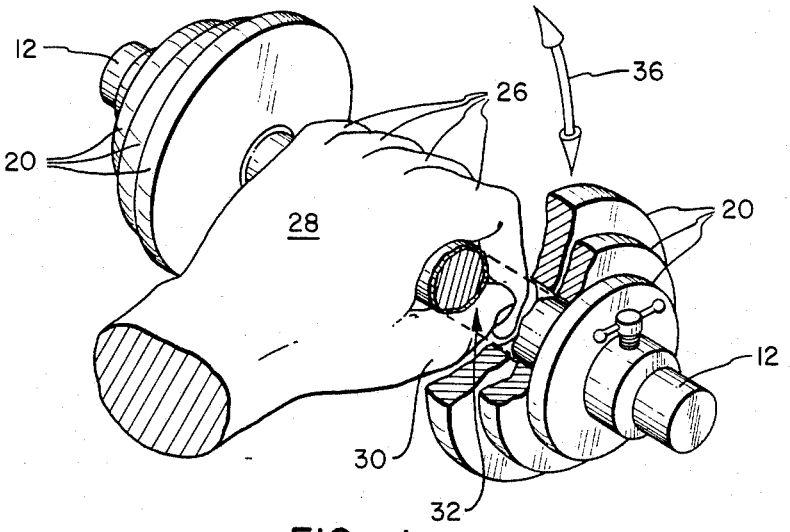
FIG. 1 (PRIOR ART)
FIG. 1 is a perspective view of a prior art device showing the orientation of the hand when performing reverse wrist curls and other palm down exercises using such prior art devices.

Interconnecting member 120 is also sometimes referred to as rest member 120 due to the fact that when in use, the back side of the operator's hand (not shown in FIG. 2 but generally designated 28 in FIG. 1) will contact pad 122. To use the device, the user of the embodiment grasps the grip member, 118 in FIG. 2, in an overhand, or palm down, position as illustrated in FIG. 1. That is, the palm of the hand faces down and the thumb and fingers are "wrapped around" grip member 118.

As explained earlier, the major difficulty in performing some weight-lifting exercises, such as reverse wrist curls, is the excessive fatigue of the thumb and fingers which are used to support the weight. Thus, the reverse curl and reverse wrist curl exercises may become an inefficient workout for the "thumb and fingers," instead of an efficient workout for the desired muscles.

After the user grasps grip member 118 in overhand fashion, the device is lifted and grip member 118 is allowed to move towards rest member 120 as indicated by phantom image 118A. In the embodiment illustrated in FIG. 2, a grip member 118 is allowed to move in the above-described fashion by way of two sleeves 116 and 124, which are each attached to an end of grip member 118.

The first sleeve 116 surrounds first leg 114 and is allowed to slide on the outer surface of leg 114. Likewise, sleeve 124 surrounds second leg 126 and is allowed to slide along the outer surface of the same. It will be appreciated that the inner surfaces of sleeves 116 and 124, or the outer surfaces of legs 114 and 126, could be provided with an anti-friction material in order to promote smooth operation. Alternatively, those skilled in the art will appreciate that other structures could be used to reduce friction and to improve the operation of sleeves 116 and 124 and leg members 114 and 126. For example, the inclusion of bearings on the inner surfaces of sleeves 116 and 124 might be such a structure.

It will be appreciated that as the user grasps grip 118 and slides it upward and rest memnber pad 122 contacts the back of the user's hand, nearly the full weight of the device, and its associated weights 110, will be transferred to the back of the user's hand. It will be appreciated that by inclusion of pad 122, the weight of the device will be more evenly distributed across the back surface of the user's hand, thus making the device comfortable to use.

Furthermore, inclusion of proper padding 122 prevents the device from sliding and moving out of position from the desired location on the user's hand. For example, the user may desire to place the rest member 120, and accompanying pad 122, over the knuckles in order to utilize the maximum load of the device. Alternatively, another user may desire to move the rest member 120, and pad 122, to a position on the back of the hand towards the wrist thus reducing the load for performing wrist curls. When using the device for performing reverse curls (using the arm rather than the wrist) it may be desired to choose a location for wrist member 120 and pad 122 directly above, or very near, the wrist so that the hand is not excessively fatigued while performing reverse curls.

It will be appreciated by those skilled in the art that many different structures could be used for rest member 120 or rest member pad 122. For example, it may be desirable under some circumstances to form rest member 120 in a substantially flat configuration such as might follow the contour of the back of a user's hand. An embodiment including such a rest member is described later. Alternatively, the cylindrical shape of rest member 120 shown in FIG. 2 may be retained while the configuration of rest member pad 122 may be altered to provide a more extensive weight-distributing function.

It will be appreciated that, as with all components of the illustrated embodiments, rest member 120 may be fabricated from many different materials, the important consideration being that the material have sufficient strength and rigidity to act as an interconnecting member between first leg 114 and second leg 126. Furthermore, it should be appreciated that the invention is not intended to be limited to the embodiment using a U-shaped member incorporating rest member 120 and first and second legs 114 and 126. Rather, it is expected that many different structures could be used to provide the function of allowing grip member 118 to move towards rest member 120. The important task being to transfer the weight-support function from the thumb and fingers to the back of the user's hand to facilitate performing reverse curls and reverse wrist curls as well as other excercises that might benefit from such a function.

In the embodiment illustrated in FIG. 2, legs 114 and 126 and rest member 120 are fabricated from a single bar of steel which is bent to form a U-shaped member. Alternatively, the U-shaped member could be forged or fabricated by other methods known to those skilled in the art. However, as will be appreciated from the previously mentioned considerations, it is not essential that the U-shaped member be used or that the U-shaped member be formed in the fashion illustrated in the figures.

Furthermore, it has been determined that the presently preferred method of attaching sleeves 116 and 124 and grip member 118 to legs 114 and 126 is to form grip member 118 and sleeves 126 and 124 in two separate halves divided longitudinally down the axis of grip member 118 and through sleeves 116 and 124. After the U-shaped member comprised of rest member 120 and legs 114 and 126 is formed, the two halves of grip member 118 and sleeves 116 and 124 may be joined together in place to create the structure illustrated in FIG. 2.

In some applications, it may be desirable to use the device illustrated in FIG. 2 without any additional weights placed on the device. Such uses might include the adaptation of the present invention for use in mechanical weight-lifting systems in which the resistance is provided by the mechanical device and thus no additional weights are necessary on the embodiment. In such a case, weight support bars 102 and 132 may be omitted.

Weight-support bars 102 and 132 may be configured to accept standardized sizes of weights 110, as shown in FIG. 2, so that the weight of the device may be varied according to the desires of the user. In order that weights 110 do not interfere with the sliding function of grip member 118, a first spacer 112 and a second spacer 128 are provided on weight-support bars 102 and 132, respectively.

In the embodiment illustrated in FIG. 2, weight support bars 102 and 132 are provided with threads 104 and 130, respectively. After weights 110 are placed on respective weight support bars 102 and 132, collars 106, each provided with a non-slip surface 108, may be threaded onto weight-support bars 102 and 132 to hold weights 110 in their proper position. It will be appreciated that weight support bars 102 and 132 may be formed as integral pieces with legs 114 and 126. Alternatively, weight support bars 102 and 132 may be attached to legs 114 and 126 in some other fashion. It will be appreciated that weight-support bars 102 and 132 need not be positioned at the ends of legs 114 and 126 but could be located in other positions on the device illustrated in FIG. 2.

The embodiment illustrated in FIG. 2 is particularly useful in performing reverse wrist curls. As will be appreciated, when performing reverse wrist curls it is desirable that only the wrist be allowed to move. It is common for many individuals to perform reverse wrist curls in a sitting position with their forearm placed on their thigh and their hand extending past their bent knee.

In this fashion, the forearm is well-supported while only the wrist is free to move and thus perform the exercise most efficiently. By using the embodiment illustrated in FIG. 2, wherein the weight support members are positioned perpendicularly from the ends of legs 114 and 126, reverse wrist curls may be performed without the weights 110, or the device, coming in contact with the user's leg, and potentially causing a painful impact in the shin area.

Figure 3:
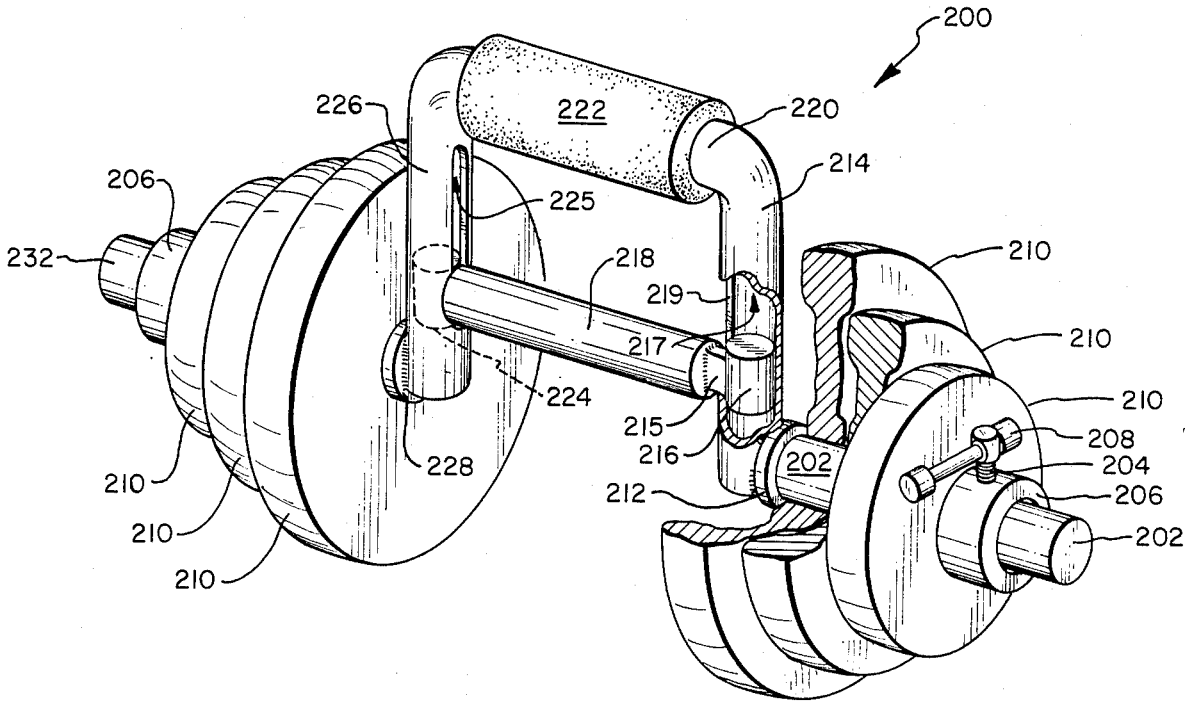
FIG. 3 is a perspective view of another presently preferred embodiment of the present invention showing locking bolts used to secure the grip member in any one of a plurality of positions.

Another preferred embodiment of the present invention is illustrated in FIG. 3 and is generally designated 200. The embodiment illustrated in FIG. 3 is generally similar to embodiment 100 illustrated in FIG. 2. That is, rest member 220, which is provided with pad 222, and first leg 214 and second leg 226 form a generally U-shaped member. Likewise, weight support bars 202 and 232 are perpendicularly attached to the ends of legs 214 and 226, respectively. However, the positioning mechanism which allows grip member 218 to move towards rest member 220 is different than that illustrated in FIG. 2.

In the embodiment illustrated in FIG. 3, grip member 218 is able to slide in relation to rest member 220 by use of a key and groove arrangement. Grip member 218 is provided with axially protruding keys, only one of which is shown at 215, which slide within grooves 219 or 225, also termed slots 219 or 225, shown in FIG. 3. Grooves 219 and 225 are provided in hollow legs 214 and 216, respectively. Furthermore, cylindrical blocks 216 and 224 may be provided within hollow legs 214 and 226, and attached to keys, such as 215, to provide for smoother operation of the device. As with the embodiment illustrated in FIG. 2, it should be appreciated that anti-friction materials, bearings, or some other structure may be interposed between the surfaces of legs 214 and 216, grooves 219 and 225, and the keys attached to grip 218 and cylindrical blocks 216 and 224.

It will also be appreciated that weight support bars 202 and 232 in the embodiment illustrated in FIG. 3 are no longer provided with threads but the weights are kept in place by collars 206, each provided with a set bolt 204 and a finger lever 208.

Figure 4:
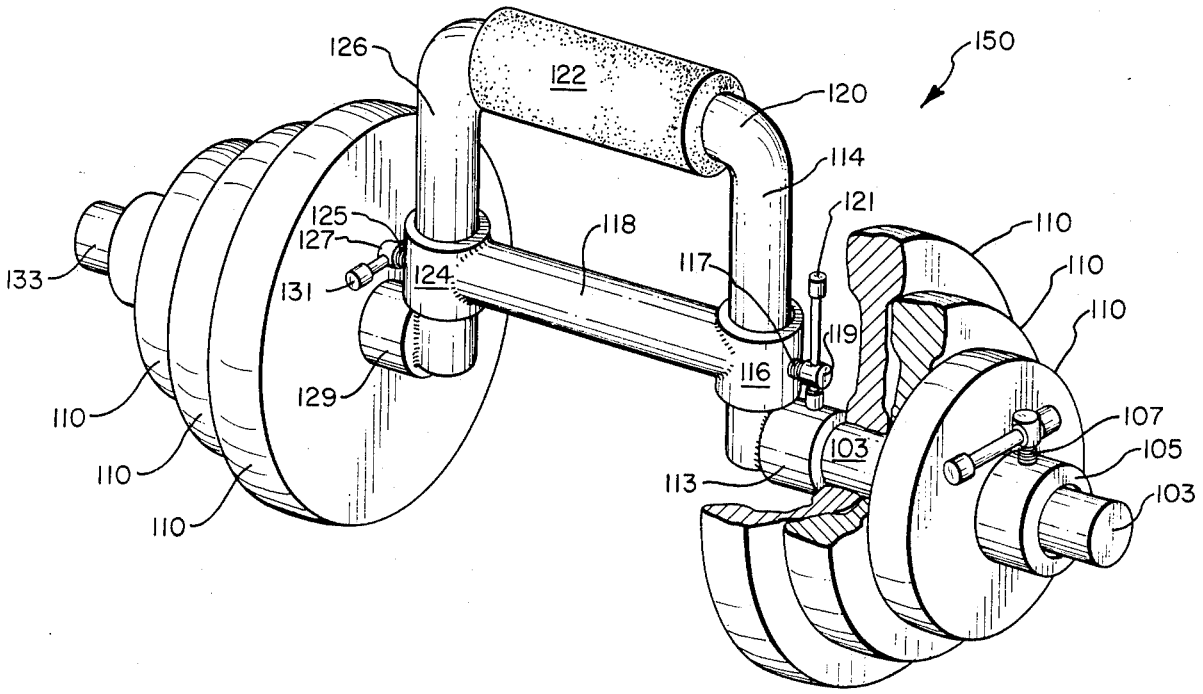
FIG. 4 is a perspective view of yet another presently preferred embodiment of the present invention.

Another preferred embodiment of the present invention is illustrated in FIG. 4 and is generally designated 150. Embodiment 150 is generally similar to embodiment 100 illustrated in FIG. 2. However, sleeves 116 and 124 have been modified by the addition of sleeve set bolts 117 and 125, respectively. Set bolts 117 and 125 are each provided with heads 119 and 125, respectively, which incorporate finger levers 121 and 131 spacers 113 and 129 are provided to prevent weights 110 from interfering with the movement of grip 118 and sleeves 116 and 124.

The purpose of sleeve set bolts 117 and 125 is to lock grip member 118 in any particular position on legs 114 and 126 is desired by the user. Sleeves 116 and 124, are each provided with threaded bores into which set bolts 117 and 125 are inserted. It will be appreciated that many different structures could be used to provide the locking function if it was desired to lock grip member 118 in a particular position in relation to the rest member 120.

Figure 5:
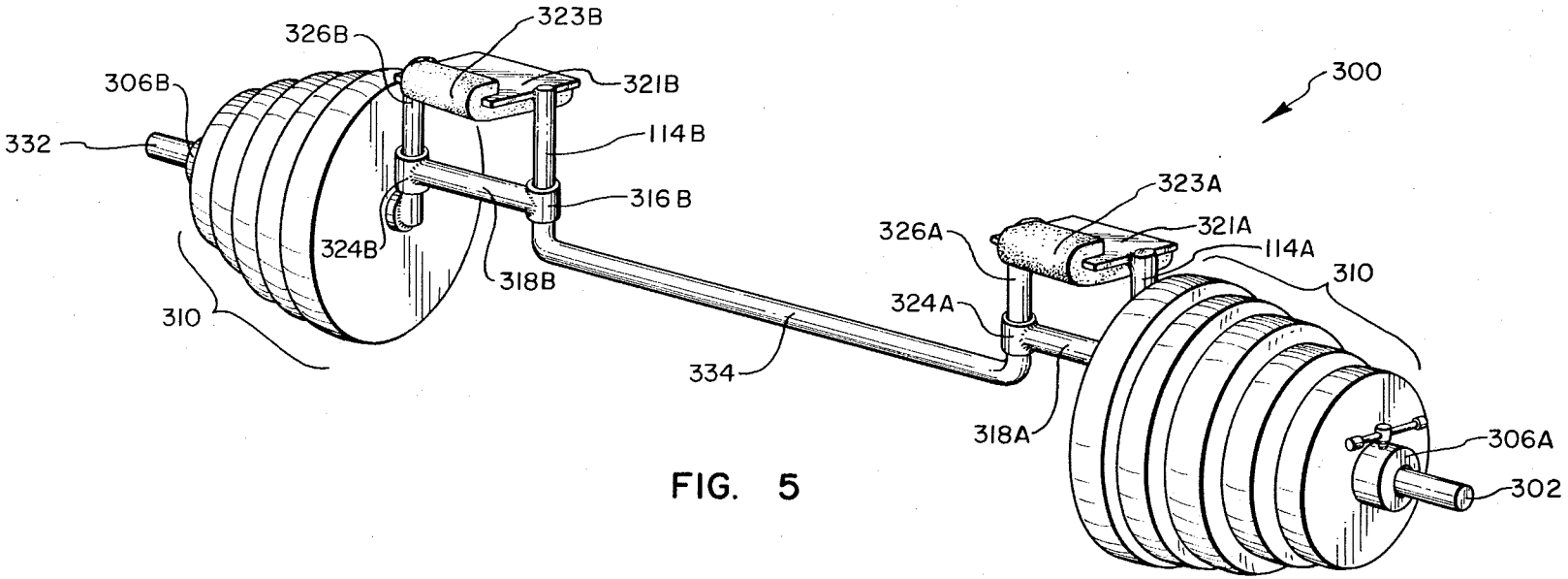
FIG. 5 is a perspective view of another presently preferred embodiment wherein the present invention has been incorporated into a barbell type device.

Another preferred embodiment of the present invention is illustrated in FIG. 5. The embodiment illustrated in FIG. 5 is particularly adapted for performing reverse curls. As will be appreciated by an examination of FIG. 5, the embodiment incorporates the present invention into a barbell-type device. Examination of FIG. 5 will show that the cylindrical rest members found on other embodiments have been replaced by flat rest members 321A and 321B with pads 323A and 323B to more evenly distribute the load across the hand, and in some cases, the wrist and forearm.

The embodiment illustrated in FIG. 5, generally designated 300, is provided with two grip members 318A and 318B which cooperate with associated rest members 321A and 321B, pads 323A and 323B, as well as legs 114A and 114B and 326A and 326B. Thus, it will be appreciated that the embodiment illustrated in FIG. 5 operates in generally the same way as the embodiment illustrated in FIG. 2 but by providing an interconnecting bar 334, structures similar to the embodiments illustrated in FIG. 2 may cooperate to allow the present invention to be incorporated into a barbell form.

By the addition of weights 310 supported by weight support bars 302 and 322, and kept in place by retaining collars 306A and 306B, the embodiment illustrated in FIG. 5 may be used to efficiently perform reverse curls or any other exercise which would be appropriate for use with the embodiment.

Figure 6:
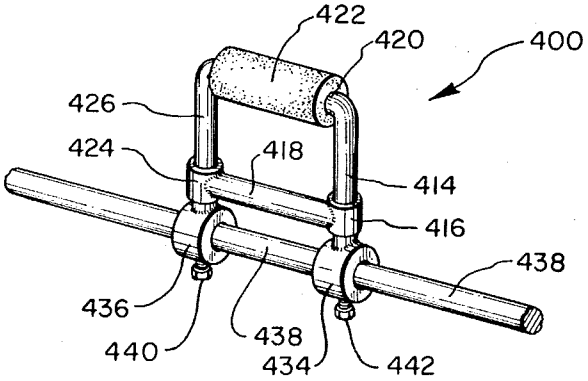
FIG. 6 is a perspective view of another presently preferred embodiment of the present invention which is adapted to retrofit prior art type dumbbells and barbells.

The embodiment illustrated in FIG. 6, generally designated 400, may be used to retrofit a conventional weight-lifting bar or dumbbell bar with the structure of the present invention. Alternatively, embodiment 400 may be incorporated into a barbell type device. If two of the embodiments illustrated in FIG. 6 are incorporated into a barbell arrangement, the additional advantage of the being able to vary the distance between the two devices is gained. For example, a large male user may desire that grips 418 (only one is shown in FIG. 6) be placed two feet apart while a small female user may prefer a one foot spacing. In order to make the embodiment illustrated in FIG. 6 most useful, weight support bars 402 and 432 are also provided so that the embodiment may be used by itself or on a bar 438.

As can be seen in FIG. 6, the embodiment includes a rest member 420 with a pad 422, as well as grip member 418 which is provided with sleeves 416 and 422 which surround legs 414 and 426, respectively. Attaching rings 436 and 434 are intended to slide onto a bar 438. Thus, the present invention may be adapted for use with a conventional barbell.

It will be appreciated that many different structures could be used to secure the position of attaching rings 434 and 436 to bar 438. In the embodiment of FIG. 6, set bolts 440 and 442 are provided to secure the device in the desired position. Furthermore, it will be appreciated by those skilled in the art that many different structures other than attaching rings 434 and 436 can be used to attach embodiment 400 to a conventional bar 438. For example, many different styles of clamps, or rings provided with a hinged opening, (neither shown in FIG. 6) could also be used.

By considering the above description of the preferred embodiments, it will be realized that the present invention provides a device which allows the user to grasp a bar, or other object, in a palm down position without requiring that the thumb and fingers experience excessive fatigue. By transferring the load onto the back of the user's hand, thumb and finger fatigue can be avoided. In particular, the present invention provides an apparatus which improves on any devices available in the art for performing reverse curls, reverse wrist curls, or other similar weight-lifting exercises. Moreover, the present invention allows these exercises to be performed without the danger of dropping a weight due to thumb and finger fatigue as well as providing the advantage of being usable in a dumbbell, barbell, or retrofit configuration.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by U.S. Letters Patent is:

1. A hand grasp device for placing a load on the back of a human hand comprising:

rest means for providing a location for supporting the load on the back of the human hand, said rest means being cushioned;

load holding means, offset from and connected to the rest means, for securing a load to the device;

grip means for providing a location for gripping by the human hand; and positioning means for allowing the grip means to continuously move through a variable spaced relationship in a substantially straight line from the rest means whereby the back of the human hand is brought into contact with the rest means.

2. A device as defined in claim 1 wherein the rest means comprises an interconnecting bar member, the interconnecting bar member being provided with a pad means adapted for distributing a load over the back of a human hand.

3. A device as defined in claim 1 further comprising a pair of parallel leg members and wherein the rest means comprises an interconnecting rest member disposed perpendicularly between the pair of parallel leg members.

4. A device as defined in claim 3 wherein the interconnecting rest member is cushioned to distribute the load over the back of the human hand.

5. A device as defined in claim 3 wherein the grip means comprises a grip member disposed between the pair of parallel leg members.

6. A device as defined in claim 1 wherein the positioning means comprises:

a pair of parallel leg members extending substantially perpendicularly from the rest means; and means for slidably connecting the grip means to the pair of parallel leg members.

7. A device as defined in claim 6 wherein the means for slidably connecting comprises sleeves connected at each end of the grip means, wherein each of the parallel leg members slidably engage one of the sleeves.

8. A device as defined in claim 6 wherein the means for slidably connecrting comprises a groove in each of the two parallel leg members and the grip means is provided with a key disposed at each of its ends, each key slidably engaging one of the grooves.

9. A device as defined in claim 1 further comprising means for releasably locking the grip means in a plurality of spaced relationships from the rest means whereby the grip means may be locked at a desired distance form the rest means.

10. A device as defined in claim 9 wherein the means for releasably locking comprises a locking bolt adapted for frictionally holding the grip means in a spaced relationship from the rest means.

11. A device as defined in claim 1 further comprising means for supporting a plurality of individual weights.

12. A device as defined in claim 1 wherein the device is adapted to be used with one hand in a dumbbell-like fashion.

13. A device as defined in claim 1 further comprising an interconnecting bar, the interconnecting bar joining a pair of rest means located near each of its ends, the rest means having grip means associated with each rest means, the device being adapted for use in a barbell-like fashion.

14. A device as defined in claim 1 further comprising:

a substantially straight bar, the substantially straight bar being adapted to receive two rest means and their associated grip means and positioning means; and means for releasably connecting the two rest means to the substantially straight bar whereby both rest means may be simultaneously connected to the substantially straight bar and the distance between the two rest means may be varied to facilitate the use of the device in a barbell-like fashion by a variety of users.

15. A device as defined in claim 1 further comprising means for releasably attaching the device to a conventional weight bar.

16. A device to facilitate the grasp of a human hand on a bar-like member and transferring a substantial amount of the force exerted by a load from the fingers and thumb to the back of the hand comprising:

a pair of parallel leg members;

an interconnecting rest member rigidly and substantially perpendicularly attached between the pair of parallel leg members, the interconnecting rest member adapted to support a load on the back of a human hand;

means for holding the load in a fixed space relationship with the interconnecting rest member;

a grip member disposed between the pair of parallel leg members and in a parallel spaced relationship from the interconnecting rest member; and positioning means for allowing the grip member to continuously move through a variable spaced relationship in a substantially straight line from the interconnecting rest member whereby the back of the human hand is brought into contact with the rest means.

17. A device as defined in claim 16 wherein the interconnecting rest member is provided with a cushion for distributing the load across the back of a human hand.

18. A device as defined in claim 16 wherein the positioning means comprises a pair of sleeves, each of the sleeves attached to one end of the grip member, and wherein each of the parallel leg members is slidably inserted through one of the sleeves.

19. A device as defined in claim 16 wherein the positioning means comprises a longitudinal groove in each of the parallel leg members and the grip member is provided with a key protruding from each end, each of the keys slidably engaging one longitudinal groove.

20. A device as defined in claim 16 further comprising means for releasably locking the grip member in any one of a plurality of spaced relationships from the interconnecting rest member.

21. A device as defined in claim 20 wherein the means for releasably locking comprises a locking bolt adapted for frictionally holding the grip member in one spaced relationship from the interconnecting rest member.

22. A device as defined in claim 16 further comprising means for releasably securing a plurality of weights to the device.

23. A device as defined in claim 16 further comprising means for releasably securing an end of each parallel leg member to a conventional weight bar whereby the device may be releasably secured to the conventional weight bar.

24. A device as defined in claim 16 further comprising:

a straight bar;

a pair of interconnecting rest members;

two grip members and two positioning means, one of the two grip members and two positioning means being associated with each interconnecting rest member;

means for allowing the two interconnecting rest members to be movably secured to the straight bar whereby the distance between the interconnecting rest members may be varied.

25. A weight training device for performing reverse wrist curls comprising:

a U-shaped member comprising:

a pair of parallel leg portions; and an interconnecting portion, the interconnecting portion comprising means for distributing a load across the back of a human hand;

means for attaching a weight to the U-shaped member; and a slidable grip adapted to be grasped by the human hand, the slidable grip having a pair of ends, each of the ends being slidably connected to one of the parallel leg portions such that as the slidable grip is grasped by the human hand, with the palm facing away from the interconnecting portion, the slidable grip may be continuously moved toward the interconnecting portion in a substantially straight line until the back of the hand contacts the interconnecting portion whereby the back of the hand is the body structure which bears a substantial portion of the weight of the U-shaped member.

26. A device as defined in claim 25 further comprising a sleeve attached to each end of the slidable grip, each sleeve having one parallel leg portion inserted therethrough whereby the slidable grip is allowed to slide along the two parallel leg portions.

27. A device as defined in claim 25 further comprising a pair of keys, each key protruding from an end of the slidable grip and each parallel leg portion is provided with a groove along its length, each key slidably engaging one groove whereby the slidable grip is allowed to slide along the two parallel leg portions.

28. A device as defined in claim 25 further comprising weight support means perpendicularly connected to the pair of parallel leg portions.

29. A device as defined in claim 25 further comprising:

a straight bar; and means for securing two U-shaped members to the straight bar whereby the straight bar may be used in a barbell-like fashion.

30. A device as defined in claim 29 further comprising means for releasably securing the U-shaped members to the straight bar whereby the distance between the two U-shaped members on the straight bar may be varied.

31. A weight training device comprising:

a pair of hand grasp devices each comprising:

rest means for providing a location adapted for supporting a load on the back of a human hand, said rest means being cushioned;

grip means for providing a location for gripping by the human hand; and positioning means for allowing the grip means to continuously move through a variable spaced relationship in a substantially straight line from the rest means whereby the human hand is brought into contact with the rest means; and a bar, each of the hand grasp devices being secured to the bar such that the rest means is offset from the bar.

32. A device as defined in claim 31 wherein each of the hand grasp devices may be releasably secured to the bar.

33. A device as defined in claim 31 wherein the distance between the locations on the bar where each of the hand grasp devices is positioned may be varied.

* * * * *